United States Patent [19]

Kapner et al.

[11] 4,406,872

[45] Sep. 27, 1983

[54] DESULFURIZATION OF DELAYED PETROLEUM COKE

[75] Inventors: Robert S. Kapner, West Caldwell, N.J.; Robert O'Brien, Woodside, N.Y.

[73] Assignee: Diamond West Energy Corporation, New York, N.Y.

[21] Appl. No.: 267,782

[22] Filed: May 28, 1981

[51] Int. Cl.[3] ..... C01B 57/00; C01B 31/26; C09C 1/56; C01B 31/02

[52] U.S. Cl. ..... 423/461; 208/208 R; 201/17; 423/444; 423/460

[58] Field of Search ..... 423/444, 445, 460, 461, 423/443, 449; 201/17; 208/208

[56] References Cited

U.S. PATENT DOCUMENTS

| | | | |
|---|---|---|---|
| 2,717,868 | 9/1955 | Gorin et al. | 423/461 |
| 2,739,105 | 3/1956 | Ford et al. | 201/17 |
| 3,009,781 | 11/1961 | Johnson et al. | 423/444 |
| 3,598,528 | 8/1971 | Franz et al. | 201/17 |
| 4,011,303 | 3/1977 | MacGregor | 423/444 |
| 4,160,814 | 7/1979 | Hardin et al. | 423/461 |
| 4,203,960 | 5/1980 | Bauer et al. | 423/445 |

FOREIGN PATENT DOCUMENTS 855246 11/1960 United Kingdom ..... 201/17

OTHER PUBLICATIONS

The Oil and Gas Journal, Jan. 22, 1979, pp. 64–68, "Thermal Process is Developed for Petroleum Coke Desulfurization," by Fernando Manzanilla Sadilla, Oliverio Moreno LaMonte, M. C. Sze, and W. V. Bauer.

*Primary Examiner*—Gary P. Straub

*Attorney, Agent, or Firm*—Cooper, Dunham, Clark, Griffin & Moran

[57] ABSTRACT

Delayed coke is desulfurized by first contacting the coke with an active sulfur-bearing gas at a temperature high enough to produce a reaction between the sulfur in the coke and the active sulfur in the gas, and then holding the coke in contact with the gas at said high temperature for approximately one hour. An alternative process provides for desulfurization of delayed coke by modifying the second step of the prior process to dilute or replace the sulfur-bearing gas with an inert gas. In a third alternative, the foregoing process is further modified by lowering the temperature during the second or holding step to maintain the reaction between the sulfur-bearing gas and the coke.

3 Claims, No Drawings

DESULFURIZATION OF DELAYED PETROLEUM COKE

BACKGROUND OF THE INVENTION

1. Field of the Invention

This invention relates to the calcination and desulfurization of delayed petroleum coke by programmed contact with sulfur-bearing gases at elevated temperatures for metallurgical and chemical applications.

The high sulfur content of many dalayed cokes renders them unsuitable for important commercial uses. This has limited use of such cokes, which are relatively inexpensive, readily available refinery by-products, as sources of raw materials and energy for metallurgical and chemical applications. In such applications, the sulfur in the coke poses problems of end product quality, manufacturing productivity and pollution control. Current trends in crude oil supply portend still higher sulfur levels in the future.

Carbon products such as anodes for aluminum production and electrodes for ferrous metallurgy are conventionally made from calcined delayed coke. Delayed coke is obtained from a variety of feedstocks (reduced crude, vacuum resid, thermal tar and decant oil) by fractionating these materials and by further cracking of the heavy fraction in coke drums to yield vapor and coke. The major type of delayed coke, "sponge coke", is a porous, crystalline material which, after calcining to remove volatiles and to refine the structure, is a suitable ingredient for carbon products.

Another form of delayed coke is "needle coke", which can be produced in delayed cokers. It has superior physical and chemical properties which make it suitable for more demanding uses such as electrodes for ferrous metallurgy. Needle coke is even more crystalline than sponge coke and provides even greater hardness and strength.

The sulfur in such delayed cokes is a function of the sulfur in the feedstock from which the cokes are made. High sulfur in the coke is not substantially removed by conventional calcining and can carry through to the end carbon product, causing structural deficiencies and other undesirable qualities in the end carbon product. This invention provides a process that substantially desulfurizes delayed coke so as to permit accommodation of higher sulfur feedstocks in the production of delayed cokes.

Cokes produced by the fluid coke process are unacceptable for anode production without special treatment because of their physical and chemical properties. In a process distinctly different from delayed coking, fluid coking converts heavy, low-grade oil into a coke which has an onion-skin, relatively amorphous structure which does not provide the required hardness, strength, bonding and handling characteristics required in anode manufacture. It does not graphitize properly during processing. Further, its relatively high coefficient of thermal expansion and its low electrical conductivity adversely affect carbon product quality. Fluid coking tends to produce a product of unacceptably high metals content by nature of the process. Accordingly, the majority of fluid coke is burned as a boiler fuel by the producing refiner and is reserved for the dirtiest feedstockes. Its poorer qualities for carbon products have led to the development of processes to maximize the liquid and gaseous products from such coke and to minimize the solids, e.g., by gasifying the coke. In the few instances where special technology and further grinding are applied to fluid coke for use in carbon products, it must be blended with delayed coke to minimize adverse impacts on end product quality.

2. Description of the Prior Art

Desulfurizing methods disclosed in the prior art involve extended treatment periods (up to several hours) at elevated temperatures or involve intimate contact with liquid desulfurizing agents. Such prior art methods may require excessive energy, capital investment, material costs, and additional steps in product purification and waste stream treatment. Those desulfurization methods which expose the coke to inert gas do not achieve maximum desulfurization.

This invention provides modification of conventional calcining facilities, some of which may be co-located at refineries where the delayed coke and the sulfur gases are produced, to permit programmed introduction of sulfur gases (such as refinery sour gas, hydrogen sulfide, mercaptans, or other sources of active sulfur) as desulfurizing agents, producing by a gas-solid reaction a low sulfur (less than one percent by weight) end product otherwise similar to conventionally calcined delayed petroleum coke. Recovery and recycle of effluent gases would be by conventional means.

Prior publications and patents describe efforts to use heat-carrying inert gas to desulfurize cokes. As described in the *Oil and Gas Journal,* Jan. 22, 1979, pg. 64–68, a thermal process developed by C-E Lummus and Institute Mexicano del Petroleo involves from three to nine hours of treatment at elevated temperature. Desulfurized coke yield, not addressed in the publication, may be adversely affected by prolonged exposure at high temperature.

U.S. Pat. No. 4,160,814 discloses a thermal process with data showing extensive desulfurization with nitrogen as the inert medium but there is no suggestion that other gases may be used.

U.S. Pat. No. 3,009,781 deals only with fluid coke which, as described earlier, is generally unacceptable for the uses intended for the invention. The patent presents a two-stage process in which the first stage is intended to raise the thermal conductivity of the bed to permit electrothermic production of carbon disulfide and to reduce the sulfur in the fluid coke, and in which the second stage involved passing a stream of gas through the bed. The gas is selected from the group consisting of nitrogen, carbon monoxide, hydrogen, mixtures of carbon monoxide, hydrogen and nitrogen, and hydrogen sulfide. However, U.S. Pat. No. 3,009,781 pat. does not correctly distinguish between inert gases, and active gases, such as carbon monoxide which attacks the carbon and hydrogen sulfide which decomposes to form an active sulfur agent. In addition, temperature control disclosed in U.S. Pat. No. 3,009,781 pat. is insufficient to separate thermal effects from other effects. Moreover, no account is taken for the attack on carbon alone with concomitant coke loss versus other possible chemistry. U.S. Pat. No. 3,009,781 pat. also incorrectly implies a continuous improvement in sulfur removal with increased temperature and holding time.

U.S. Pat. No. 4,011,303 is the first to disclose the chemical effect of gaseous, active sulfur to remove sulfur from the coke. Without reference to heating prior to reaction, U.S. Pat. No. 4,011,303 pat. discloses the use of elemental sulfur vapor diluted with nitrogen as the agent in a one-step process in which the elemental sulfur combines with carbon-sulfur groups in the coke (the desired reaction) and with carbon alone in the coke ( undesired because it results in carbon loss with little desulfurization).

When sulfur is vaporized, as in U.S. Pat. No. 4,011,303, various species of sulfur are generated (e.g., $S_8$, $S_6$, $S_2$). However, active sulfur species can be generated by other means. For example, it is known that hydrogen sulfide ($H_2S$) decomposes at elevated temperature to form gaseous hydrogen and sulfur. Carbon monoxide and sulfur dioxide react to form carbon dioxide and gaseous sulfur. Carbonyl sulfide in the presence of water produces sulfur. Thus, active sulfur may be generated for use in desulfurization by decomposition of sulfur gases and by reaction of gases containing sulfur. This chemistry is incorporated in the subject invention.

SUMMARY OF THE INVENTION

The present invention provides a process for calcining and desulfurizing delayed coke by: (a) contacting the coke at a reaction temperature of 1400° C. and higher with active sulfur-bearing gas (refinery sour gas, hydrogen sulfide, mercaptans or other sources of active sulfur) for a period from 5 minutes to 30 minutes, that is, until the advantage over using inert gas has diminished; and (b) continuing the active sulfur-bearing gas flow for up to one hour at elevated temperature with diminished concentration of the sulfur gas until the desired endpoint, e.g., less than one percent by weight in the coke, is reached. In step (a), the sulfur gas may be diluted to minimize coke loss. In step (b), the temperature may be lowered to minimize exposure to the highest temperature. A third and finishing step resembling step (a) may be added to obtain the lowest sulfur content in the product coke. Raising the coke to reaction temperature by various paths is sufficient to remove volatiles which are undesirable in coke for carbon end products and which might otherwise inhibit action of the active sulfur. Maximum desulfurization and yield are achieved by introducing the sulfur-bearing gas to the delayed coke when reaction temperature is reached and by diluting of replacing the sulfur gas with inert gas after a short period (after which the coke loss reaction would otherwise dominate), and continuing thermal treatment until the desired endpoint is reached.

The process of this invention is suitable for known industrial heating facilities for delayed petroleum coke such as kilns, furnaces, and other calcination systems. To the extent that gases already generated on-site can be used in this process, significant capital investment savings may be realized.

DETAILED DESCRIPTION OF THE INVENTION

1. Description of Tests and Analysis

All tests were conducted using a fixed coke bed of approximately twenty (20) grams of uncalcined delayed coke contained in a ceramic reactor tube installed within a high temperature furnace for external heating. Reagent and inert gases flowed through upstream drying, flow measurement, and pre-heating apparatus and thence through the coke bed. Temperature instrumentation, measurement, and control permitted stable and responsive performance and reproducible operating conditions. Coke samples were weighed prior to and after treatment to determine coke loss. Unless otherwise specified, all cokes were crushed and screened and that fraction used which passed 12 mesh but was retained on 20 mesh (U.S. Sieve Series). Tests were made with nitrogen feed gas alone to establish time/temperature/-desulfurization relationship and to permit modelling by equations representing thermal decomposition and diffusion. These, combined with runs with sulfur-bearing gases, were sufficient to permit modelling of behavior with sulfur agent present.

2. Description of the Preferred Embodiments

The preferred embodiments of the novel process of the invention will now be described in the following non-limiting examples and discussion.

It is helpful first to summarize the test-based analytical results. Table 1 shows the results for nitrogen feed gas in which some of the figures were derived from experimental results and other were derived from the "shrinking core" model described below:

TABLE 1

| Time @ Holding Temperature (Minutes) | Percent Desulfurization During Holding Period | | |
|---|---|---|---|
| | 1400° C. | 1500° C. | 1550° C. |
| 10 | 3.4 | 19.7 | 44.0 |
| 20 | 6.7 | 39.2 | 68.6 |
| 30 | 10.1 | 55.2 | 74.7 |
| 45 | 15.2 | 67.6 | 78.1 |
| 60 | 20.2 | 73.2 | 79.9 |

At 1400° C. and lower, an essentially linear/sulfur relationship exists as sulfur in the coke is driven off by thermal cracking. At 1550° C. and higher, the decomposition is much faster but the desulfurization slows in the first 30 minutes as transport of the gaseous products becomes limiting.

It should be noted that variation in temperature during tests is to be avoided for correct interpretation of results. The figures in Table 1 represent a "shrinking core" model in which the sulfur content in the coke is reduced first near the outer surface and over time at greater and greater penetration of the coke of the coke particles. As the core of higher sulfur content is shrunk, it becomes more difficult for gaseous products to move through the tortuous path of pores to the surface and the decomposition becomes limited by this diffusion process.

When sulfur-bearing gas is introduced, there is a significant advantage over thermal treatment, shown in Table 2:

TABLE 2

| Time @ Holding Temperature (Minutes) | Percent Desulfurization During Holding Period at 1500° C. | |
|---|---|---|
| | Nitrogen | Sulfur Gas |
| 10 | 19.7 | 24.0 |
| 20 | 39.2 | 47.7 |
| 30 | 55.2 | 66.4 |
| 45 | 67.6 | 79.9 |
| 60 | 73.2 | 85.7 |

During this period, carbon-sulfur bonds in the coke are attacked by the added sulfur and reaction with sulfur takes place in addition to thermal effects. As the exposure is prolonged, however, an undesirable second reaction of added sulfur with carbon alone takes place with concomitant loss of coke and slower rate of desulfurization. After about thirty minutes at the temperature shown, a plot of the data in Table 2 would show parallel curves or a constant advantage of the sulfur gas compared with nitrogen. Thus, adding a sulfur gas will accomplish greater desulfurization, show a greater percentage improvement in the early stages, and reach a lower final sulfur content. If desired, the exposure to sulfur gas can be programmed so as to minimize exposure time at the highest temperature, minimize carbon loss, and achieve maximum desulfurization. In such a program the coke is first exposed to a sulfur gas such as hydrogen sulfide for a relatively short period, for example, under 10 minutes, at a relatively high temperature, say 1600° C., after which nitrogen gas is introduced to purge the hydrogen sulfide and the temperature is lowered to about 1500° C. The first and second stages may have a combined elapsed time of about 10 minutes, and the coke is then re-exposed to either more dilute sulfur gas or continued in nitrogen at the lower (1500° C.) temperature for an additional time period until the desired end point is reached. Such additional time period may be about one hour. The examples which follow demonstrate desulfurization with sulfur-bearing gases, the improvement over inert gas, and the effects of treatment and diluents on coke yield.

EXAMPLE 1

An uncalcined delayed coke of about 4.0 wt % sulfur content was exposed to pure hydrogen sulfide gas for one hour at 1400° C. after an initial heating period in nitrogen. The yield-adjusted desulfurization was 58%. In Example 1A, the procedure above was carried out using nitrogen alone, resulting in a comparable desulfurization figure of 39%. In numerous other tests of the two gases at other temperatures and holding times and with variations in the time/temperature approach to the reaction or holding temperature, the hydrogen sulfide resulted in greater desulfurization and somewhat lesser yield than the nitrogen (see Example 5 et seq.).

EXAMPLES 2, 3 AND 4

An uncalcined delayed coke of about 4.3 wt % sulfur content was exposed to a mixture of carbon monoxide and sulfur dioxide (known to react to form active sulfur) for one hour at 1400° C. The yield-adjusted desulfurization was 39%. In Example 2A, the above was carried out with nitrogen alone, resulting in a comparable desulfurization figure of 33%. In Example 3, the same coke was exposed to carbon monoxide/sulfur dioxide mixture for one hour at 1500° C., resulting in a desulfurization of 84%. In Example 3A, this was carried out using nitrogen alone, but on several different cokes with desulfurization ranging from 74% to 78%. In Example 4, an uncalcined delayed coke of about 3.90 wt % sulfur content was exposed to carbon monoxide/sulfur dioxide mixture for one hour at 1500° C. after a short, low temperature pre-heating period in nitrogen (40 minutes at 600° C. compared with two hours at 900° C. for other examples). The desulfurization was 77% compared with Example 4A using nitrogen alone for which the comparable figure was under 70% .

EXAMPLE 5

An uncalcined delayed coke of about 3.90 wt % sulfur content was exposed to pure hydrogen sulfide for forty-five minutes at 1500° C. after a short, low temperature pre-heating period in nitrogen. The desulfurization produced a coke of 0.98 wt % sulfur and a yield of 80%. In Example 5A, this carried out with a mixture of hydrogen sulfide (33%) and nitrogen resulting in a final product sulfur content of 0.99% but a yield of over 85%. In Example 5C, this was carried out with nitrogen alone, resulting in a final sulfur content of 1.35% and a yield of 87.5%.

EXAMPLES 6, 7, 8 AND 9

An uncalcined delayed coke of about 3.90 wt % sulfur was held under nitrogen for 40 minutes at 600° C. and then exposed to pure hydrogen sulfide at 1500° C. for 10 minutes (Example 6), 20 minutes, 30 minutes, 45 minutes, and (Example 9) 60 minutes. The same procedure was carried out with nitrogen alone in corresponding Examples 6A through 9A. The results are tabularized below:

TABLE 3

| Holding Time | FINAL S % | | YIELD % | |
|---|---|---|---|---|
| (Minutes) | $H_2S$ | $N_2$ | $H_2S$ | $N_2$ |
| 0 | 3.78 | 3.78 | 91.1 | 91.1 |
| 10 | 2.91 | 3.23 | 87.0 | 90.0 |
| 20 | 2.10 | 2.62 | 86.4 | 88.8 |
| 30 | 1.38 | 1.76 | 83.9 | 87.0 |
| 45 | 0.94 | 1.32 | 81.3 | 87.2 |
| 60 | 0.72 | 1.14 | 78.5 | 86.4 |

While the invention has been described in detail and with reference to specific embodiments thereof, it will be apparent to one skilled in the art that various changes and modifications can be made therein without departing from the scope and spirit thereof, and therefore the invention is not intended to be limited by such description and examples.

What is claimed is:

1. A process for desulfurizing delayed coke of high sulfur content above 3% by weight, which comprises the steps of (a) raising said coke to an elevated reaction temperature in the range of 1400° to 1600° C., (b) contacting said elevated temperature coke with a first added active sulfur-bearing gas for a first period of about 5 minutes to 30 minutes wherein said first added gas is selected from the group consisting of hydrogen sulfide, carbonyl sulfide, refinery sour gas, mercaptans, carbon disulfide, a mixture of carbonyl sulfide with water, and a mixture of carbon monoxide and sulfur dioxide, wherein said first added gas is purged at the end of said first period, and (c) then contacting said coke from step (b) with a second added gas for a second period of up to one hour and maintaining said elevated temperature to obtain coke of reduced sulfur content, wherein said second added gas is selected from the group consisting of (i) an inert gas and (ii) said first added gas diluted with an inert gas.

2. A process for desulfurizing delayed coke which comprises the steps of (a) raising said coke to a first reaction temperature in the range of 1400° C. to 1600° C., (b) supplying to said coke at said first reaction temperature for a first period of about 5 minutes to 30 minutes a first added active sulfur-bearing gas selected from the group consisting of hydrogen sulfide, refinery sour gas, mercaptans, carbon disulfide, carbonyl sulfide, a mixture of carbonyl sulfide with water, and a mixture of carbon monoxide and sulfur dioxide, wherein said first added gas is purged at the end of said first period, and (c) then contacting said coke from step (b) with a second added gas for a second contact period of up to one hour at a second reaction temperature lower than said first reaction temperature to obtain coke of reduced sulfur content, wherein said second added gas is selected from the group consisting of (i) an inert gas and (ii) said first added gas diluted with an inert gas.

3. A process according to claim 2 in which said coke is again exposed to said second added gas after said second contact period for a third contact period at the same reaction temperature as said second reaction temperature.

* * * * *

UNITED STATES PATENT AND TRADEMARK OFFICE

CERTIFICATE OF CORRECTION

PATENT NO. : 4,406,872

DATED : September 27, 1983

INVENTOR(S) : Robert S. Kapner and Robert O'Brien

It is certified that error appears in the above-identified patent and that said Letters Patent is hereby corrected as shown below:

Col. 1, line 11, change "dalayed" to -- delayed --

Col. 1, line 65, change "feedstockes" to -- feedstocks --

Col. 2, lines 51-52, change "U.S. Pat. No. 3,009,781 pat." to -- the 3,009,781 patent --

Col. 2, lines 56-57, change "U.S. Pat. No. 3,009,781 pat." to -- the 3,009,781 patent --

Col. 2, line 60, change "U.S. Pat. No. 3,009,781 pat." to -- the 3,009,781 patent --

Col. 2, line 66, change "U.S. Pat. No. 4,011,303 pat." to -- the 4,011,303 patent --

Col. 3, line 41, change "of" to -- or --

Col. 4, line 27, change "linear/sulfur" to -- linear time/sulfur --

UNITED STATES PATENT AND TRADEMARK OFFICE

CERTIFICATE OF CORRECTION

PATENT NO. : 4,406,872

DATED : September 27, 1983

INVENTOR(S) : Robert S. Kapner et al.

It is certified that error appears in the above-identified patent and that said Letters Patent is hereby corrected as shown below:

Col. 4, line 38, change "coke of the coke" to -- core of the coke --.

Signed and Sealed this

Third Day of January 1984

[SEAL]

*Attest:*

GERALD J. MOSSINGHOFF

*Attesting Officer*

*Commissioner of Patents and Trademarks*